US010358760B2

(12) United States Patent
Hombroek et al.

(10) Patent No.: US 10,358,760 B2
(45) Date of Patent: Jul. 23, 2019

(54) LAUNDRY WASHING MACHINE WITH AUTOMATIC RINSE OPERATION TYPE SELECTION

(71) Applicant: Midea Group Co., Ltd., Foshan (CN)

(72) Inventors: Phillip C. Hombroek, Louisville, KY (US); Christopher G. Hoppe, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 49 days.

(21) Appl. No.: 15/198,971

(22) Filed: Jun. 30, 2016

(65) Prior Publication Data

US 2018/0002859 A1 Jan. 4, 2018

(51) Int. Cl.

| | |
|---|---|
| ***D06F 39/00*** | (2006.01) |
| ***D06F 33/02*** | (2006.01) |
| ***D06F 39/08*** | (2006.01) |
| ***D06F 39/02*** | (2006.01) |
| *D06F 35/00* | (2006.01) |

(52) U.S. Cl.

CPC ..... *D06F 39/004* (2013.01); *D06F 33/02* (2013.01); *D06F 39/003* (2013.01); *D06F 39/02* (2013.01); *D06F 39/087* (2013.01); *D06F 35/006* (2013.01)

(58) Field of Classification Search

CPC ..... D06F 33/02; D06F 35/006; D06F 39/003; D06F 39/004; D06F 39/087

See application file for complete search history.

(56) References Cited

U.S. PATENT DOCUMENTS

| | | | | |
|---|---|---|---|---|
| 4,257,708 | A | 3/1981 | Fukuda | |
| 4,889,644 | A | 12/1989 | Amberg et al. | |
| 4,986,093 | A * | 1/1991 | Pastryk | D06F 39/02 68/13 R |
| 4,987,627 | A * | 1/1991 | Cur | D06F 35/006 68/148 |
| 5,031,427 | A * | 7/1991 | Pastryk | D06F 39/083 68/208 |
| 5,167,722 | A * | 12/1992 | Pastryk | D06F 35/006 134/33 |
| 5,373,714 | A | 12/1994 | Wada | |
| 5,555,583 | A | 9/1996 | Berkcan | |
| 5,560,060 | A | 10/1996 | Dausch et al. | |
| 5,589,935 | A | 12/1996 | Biard | |
| 5,603,233 | A | 2/1997 | Erickson et al. | |

(Continued)

FOREIGN PATENT DOCUMENTS

| | | | |
|---|---|---|---|
| CN | 1378005 | A | 11/2002 |
| CN | 101935936 | A | 1/2011 |

(Continued)

OTHER PUBLICATIONS

Leveraging Lasers—Retrieved from: https://www.finisar.com/sites/default/files/resources/Appliance%20Design-VCSEL%)20turbidity%20Sensor.pdf Dec. 21, 2015.

(Continued)

*Primary Examiner* — Joseph L. Perrin
(74) *Attorney, Agent, or Firm* — Middleton Reutlinger

(57) ABSTRACT

A laundry washing machine and method utilize a fluid property sensor to dynamically select between different types of rinse operations, e.g., fill rinse operations or spin rinse operations, performed during a wash cycle.

10 Claims, 5 Drawing Sheets

(56) References Cited

U.S. PATENT DOCUMENTS

| | | | | |
|---|---|---|---|---|
| 5,611,867 | A | 3/1997 | Cooper et al. | |
| 5,731,868 | A | 3/1998 | Okey et al. | |
| 5,737,790 | A * | 4/1998 | Badger | D06F 35/006 68/12.05 |
| 5,897,672 | A * | 4/1999 | Badami | D06F 39/003 68/12.04 |
| 6,023,950 | A | 2/2000 | Battistella | |
| 6,536,243 | B2 | 3/2003 | Sasano | |
| 6,842,929 | B2 | 1/2005 | Kim et al. | |
| 7,392,813 | B2 | 7/2008 | Bertram et al. | |
| 7,421,752 | B2 | 9/2008 | Donadon et al. | |
| 8,627,524 | B2 | 1/2014 | Urbanet et al. | |
| 8,834,646 | B2 | 9/2014 | Bewley, Jr. | |
| 8,910,335 | B2 | 12/2014 | Kim et al. | |
| 9,139,946 | B2 | 9/2015 | Dogan et al. | |
| 2001/0002542 | A1 * | 6/2001 | Sasano | D06F 39/004 68/12.02 |
| 2003/0196278 | A1 | 10/2003 | Durfee | |
| 2005/0022317 | A1 * | 2/2005 | Shaffer | D06F 13/02 8/159 |
| 2008/0276964 | A1 | 11/2008 | Hendrickson et al. | |
| 2010/0095465 | A1 * | 4/2010 | Kim | D06F 35/006 8/137 |
| 2012/0060299 | A1 | 3/2012 | Kim et al. | |
| 2012/0103026 | A1 | 5/2012 | Oyama et al. | |
| 2012/0312055 | A1 | 12/2012 | Fagstad et al. | |
| 2013/0125595 | A1 | 5/2013 | Seo et al. | |
| 2013/0312202 | A1 | 11/2013 | Balinski et al. | |
| 2014/0123403 | A1 | 5/2014 | Zattin et al. | |
| 2014/0259441 | A1 | 9/2014 | Fulmer et al. | |
| 2014/0326067 | A1 | 11/2014 | Chandra et al. | |
| 2015/0000047 | A1 | 1/2015 | Obregon | |

FOREIGN PATENT DOCUMENTS

| | | | |
|---|---|---|---|
| CN | 102199854 | A | 9/2011 |
| CN | 102199855 | A | 9/2011 |
| CN | 102260981 | A | 11/2011 |
| CN | 103306096 | A | 9/2013 |
| CN | 103334257 | | 10/2013 |
| CN | 103334258 | | 10/2013 |
| CN | 103485121 | A | 1/2014 |
| CN | 203514043 | | 4/2014 |
| CN | 103797175 | A | 5/2014 |
| CN | 103898711 | | 7/2014 |
| CN | 104233700 | A | 12/2014 |
| CN | 104790179 | A | 7/2015 |
| CN | 105063956 | | 11/2015 |
| DE | 2844755 | | 4/1980 |
| DE | 102008055643 | A1 | 5/2010 |
| DE | 102010029890 | A1 | 12/2011 |
| EP | 0178031 | | 4/1986 |
| EP | 0962576 | | 12/1999 |
| EP | 2518203 | | 10/2012 |
| GB | 2262363 | | 6/1993 |
| JP | H0332699 | A | 2/1991 |
| JP | 04054998 | A * | 2/1992 |
| JP | H04122384 | A | 4/1992 |
| JP | H06218183 | A | 8/1994 |
| JP | H08141273 | A | 6/1996 |
| JP | 2011200526 | | 10/2011 |
| KR | 20140019551 | A | 2/2014 |
| WO | 2007003593 | | 1/2007 |

OTHER PUBLICATIONS

U.S. Patent Office; Office Action issued in U.S. Appl. No. 15/198,890 dated Feb. 9, 2018.
Citation of Related U.S. Patents and/or Applications, dated Feb. 14, 2018.
U.S. Patent Office; Restriction Requirement issued in U.S. Appl. No. 15/198,883 dated Jan. 18, 2018.
International Search Report and Written Opinion issued in Application No. PCT/CN2017/087805 dated Sep. 20, 2017.
International Search Report and Written Opinion issued in Application No. PCT/CN2017/087804 dated Sep. 4, 2017.
International Search Report and Written Opinion issued in Application No. PCT/CN2017/087800 dated Jul. 27, 2017.
International Search Report and Written Opinion issued in Application No. PCT/CN2017/087799 dated Sep. 13, 2017.
U.S. Patent Office; Restriction Requirement issued in U.S. Appl. No. 15/198,865 dated Mar. 27, 2018.
U.S. Patent Office; Office Action issued in U.S. Appl. No. 15/198,883 dated Apr. 20, 2018.
U.S. Patent Office; Office Action issued in U.S. Appl. No. 15/198,865 dated Jun. 13, 2018.
U.S. Patent Office; Notice of Allowance issued in U.S. Appl. No. 15/198,890 dated Sep. 6, 2018.
U.S. Patent Office; Notice of Allowance issued in U.S. Appl. No. 15/198,883 dated Sep. 12, 2018.
U.S. Patent Office; Notice of Allowance issued in U.S. Appl. No. 15/198,865 dated Jan. 24, 2019.
U.S. Patent Office; Corrected Notice of Allowance issued in U.S. Appl. No. 15/198,890 dated Nov. 23, 2018.
U.S. Patent Office; Notice of Allowance issued in U.S. Appl. No. 15/198,883 dated Nov. 21, 2018.

* cited by examiner

LAUNDRY WASHING MACHINE WITH AUTOMATIC RINSE OPERATION TYPE SELECTION

CROSS-REFERENCE TO RELATED APPLICATIONS

This application is related to the following applications, each of which is filed on even date herewith and assigned to the same assignees as the present application: U.S. patent application Ser. No. 15/198,865 entitled "LAUNDRY WASHING MACHINE WITH AUTOMATIC SELECTION OF LOAD TYPE," U.S. patent application Ser. No. 15/198,883 entitled "LAUNDRY WASHING MACHINE WITH AUTOMATIC DETERGENT DISPENSING AND/OR RINSE OPERATION TYPE SELECTION," and U.S. patent application Ser. No. 15/198,890 entitled "LAUNDRY WASHING MACHINE WITH AUTOMATIC DETECTION OF DETERGENT DEFICIT." The disclosures of each of these applications are incorporated by reference herein.

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. The settings cycle can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine.

While manual load type selection in many cases simplifies a user's interaction with a laundry washing machine, such manual selection still can lead to suboptimal performance due to, for example, user inattentiveness or lack of understanding. Therefore, a significant need continues to exist in the art for a manner of optimizing the performance of a laundry washing machine for different types of loads, as well as reducing the burden on users when interacting with a laundry washing machine.

SUMMARY

The invention addresses these and other problems associated with the art by providing a laundry washing machine and method that utilize a fluid property sensor such as a turbidity dispenser to dynamically select between different types of rinse operations, e.g., fill rinse operations or spin rinse operations, performed during a wash cycle.

In particular, in some embodiments, a laundry washing machine includes a wash tub disposed within a housing, a fluid property sensor configured to sense turbidity and/or conductivity of fluid from the wash tub, and a controller coupled to the fluid property sensor. The controller may be configured to initiate a wash phase of a wash cycle to wash a load disposed in the wash tub, determine with a fluid property sensor a fluid property value associated with the wash fluid, and select between a fill rinse operation and a spray rinse operation for a rinse phase of the wash cycle based at least in part upon the determined fluid property value.

In some embodiments, the fluid property sensor includes a turbidity sensor configured to measure turbidity of the fluid from the wash tub, and the controller is configured to select between the fill rinse operation and the spray rinse operation at least based upon turbidity of the fluid from the wash tub. Further, in some embodiments, the turbidity sensor is further configured to measure conductivity of the fluid from the wash tub, and the controller is further configured to select between the fill rinse operation and the spray rinse operation based upon conductivity of the fluid from the wash tub. In addition, in some embodiments, the controller is further configured to determine whether to perform an additional rinse operation based at least in part upon a second fluid property value sensed by the fluid property sensor after the selected fill rinse operation or spray rinse operation is performed, and in some embodiments, the controller is configured to select between the fill rinse operation and the spray rinse operation to be performed as the additional rinse operation based upon the second fluid property value. In some embodiments, the controller is configured to repeat the selected fill rinse operation or spray rinse operation as the additional rinse operation, while some embodiments further include a weight sensor operatively coupled to the wash tub to sense a weight associated with the wash tub and a fluid level sensor configured to sense a fluid level in the wash tub, and the controller is configured to dynamically select a load type from among a plurality of load types based at least upon weight and fluid level values sensed respectively by the weight and fluid level sensors, and to control a wash cycle at least based upon the selected load type.

Some embodiments also include a water inlet configured to dispense water into the wash tub, and the controller is further configured to initiate an initial fill phase of a wash cycle by controlling the water inlet to dispense water into the wash tub and to dynamically select the load type during the initial fill phase after a selected amount of water has been dispensed by the water inlet. Some embodiments also include a detergent dispenser configured to dispense detergent for washing a load disposed in the wash tub, and the controller is configured to control dispensing of detergent by the detergent dispenser based at least in part upon the fluid property value.

Some embodiments may also include a method of operating a laundry washing machine of the type including a wash tub disposed within a housing and a fluid property sensor configured to sense turbidity and/or conductivity of fluid from the wash tub. The method may include initiating a wash phase of a wash cycle to wash a load disposed in the wash tub with a wash fluid, determining with a fluid property sensor a fluid property value associated with the wash fluid, and selecting between a fill rinse operation and a spray rinse operation for a rinse phase of the wash cycle based at least in part upon the determined fluid property value.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
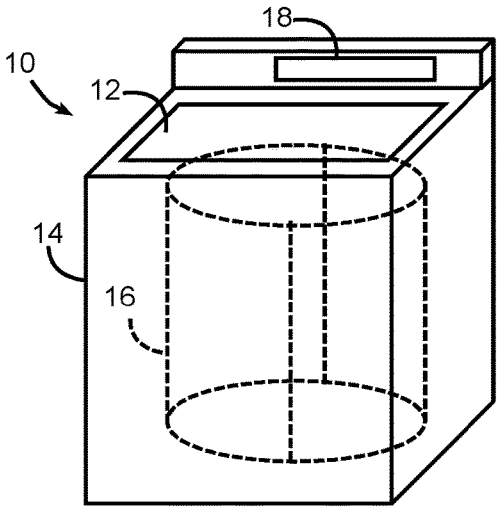
FIG. 1 is a perspective view of a top-load laundry washing machine consistent with some embodiments of the invention.

Embodiments consistent with the invention may be used to automate the selection of a load type for a laundry washing machine, as well as to control a wash cycle, and in some instances, control the dispensation of detergent, in response to sensor data collected from weight, fluid level and fluid property sensors. In particular, in some embodiments consistent with the invention, a laundry washing machine may include in part a weight sensor operatively coupled to a wash tub to sense a weight associated with the wash tub, a fluid level sensor configured to sense a fluid level in the wash tub, a fluid property sensor configured to sense turbidity and/or conductivity of fluid from the wash tub, and a controller configured to dynamically select a load type from among a plurality of load types based at least upon weight and fluid level values sensed respectively by the weight and fluid level sensors, and to control a wash cycle at least based upon the selected load type and a fluid property value sensed by the fluid property sensor, along with controlling an amount of detergent dispensed by a detergent dispenser based at least in part upon the fluid property value.

In this regard, a load type may be considered to represent one of a plurality of different characteristics, categories, classes, subclasses, etc. that may be used to distinguish different loads from one another, and for which it may be desirable to define particular operational settings or combinations of operational settings for use in washing loads of that particular load type. Load types may be defined, for example, to distinguish between colors, darks, whites, etc.; between different fabric types (e.g., natural, cotton, wool, silk, synthetic, polyester, permanent press, wrinkle resistant, blends, etc.); between different article types (e.g., garments, towels, bedding, delicates, etc.); between lightly, normally or heavily soiled loads; etc. Load types may also represent categories of loads that are unnamed, and that simply represent a combination of characteristics for which certain combinations operational settings may apply, particularly as it will be appreciated that some loads may be unsorted and may include a combination of different items that themselves have different characteristics. Therefore, in some embodiments, a load type may be associated with a combination of operational settings that will be applied to a range of different loads that more closely match that load type over other possible load types.

An operational setting, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a fill rinse operation, pre-treatment such as soaking over time with a prescribed water temperature and specific agitation stroke, etc.

As will become more apparent below, in some embodiments of the invention, a load type may be dynamically selected during an initial fill phase of a wash cycle, i.e., the phase of a wash cycle in which water is first introduced into a wash tub, and generally prior to any agitation of the load and/or draining of fluid from the wash tub, and generally without any extended soaking of the load. Thus, in contrast to some conventional approaches, load type selection may be performed with little or no delay in the initial fill phase, and thus, with little or no impact on the duration of the overall wash cycle.

Further, the dynamic selection may be based at least in part upon weight and fluid level values sensed respectively by weight and fluid level sensors operatively coupled to sense a weight and a fluid level in a wash tub after a selected amount of water has been dispensed into the wash tub. It will be appreciated that water is naturally absorbed into the garments and/or other items in a load as water in introduced into a wash tub, and that certain types and mixes of garments and items will absorb water at different rates and will displace water at different amounts. It has been found that through the use of a combination of weight and fluid level measurements, different types of loads may be distinguished because the fluid level will generally indicate the amount of displacement of the load in the wash tub as well as give an effective absorption of water when comparing to the weight. Various algorithms as discussed below may incorporate both weight and fluid level values to effectively distinguish the load type based on different major groupings and their associated load weights, rates of absorption and effective water displacements.

In some embodiments, for example, weight and fluid level values may be used to determine characteristics associated with the water absorption properties of the load, i.e., the degree to which and/or rate of which water (or any other fluid) is absorbed into the items constituting the load. In some embodiments, for example, weight and fluid level values may be used to determine first and second water absorption parameters that are each compared to empirically-determined constants associated with different load types in order to select a load type among the different load types that most closely matches the water absorption parameters.

Further, in some embodiments, one or more fluid properties, e.g., as sensed by one or more fluid property sensors, may be used to configure various operational settings for a wash cycle in addition to or in combination with a dynamically selected load type. A fluid property, in this regard, may represent one or more characteristics of a fluid in a laundry washing machine, including, but not limited to turbidity, conductivity, temperature, etc., and which, it will be appreciated, may include fluid disposed within a wash tub or otherwise disposed within a conduit or other location in fluid communication with a fluid property sensor. In some embodiments, for example, a fluid property sensor may be configured to sense at least turbidity and/or conductivity, although additional fluid properties, e.g., temperature, may also be sensed by such a sensor. Some embodiments, for example, may use a turbidity sensor that is also configured to sense conductivity and/or temperature. It will also be appreciated that multiple fluid property sensors may be used in some embodiments to sense different fluid properties. Among other purposes, for example, turbidity, conductivity and/or temperature may be used to vary a wash or rinse duration based on a level of soil or cleanliness in a load and/or an amount of detergent detected in a wash fluid.

Furthermore, in some embodiments, turbidity and/or conductivity, among other fluid properties, may also be used to control the amount of detergent dispensed by a detergent dispenser such as an automatic detergent dispenser. In addition, in some embodiments, a fluid property such as turbidity and/or conductivity may also be used to determine a detergent deficit in a wash fluid, i.e., a lower than desired amount, concentration, quantity, etc. of a detergent in a wash fluid. In some embodiments, the detergent deficit may result from a manual addition of an insufficient amount of detergent by a user, e.g., as a result of a user placing an insufficient amount of detergent in a manually-fed detergent dispenser and/or directly in a wash tub, and in response to detecting such a detergent deficit, additional detergent may be dispensed from an automated detergent dispenser.

Turbidity and/or conductivity, among other fluid properties, may also be used in some embodiments to select from among different types of rinse operations, e.g., to select between a fill rinse operation and a spray rinse operation. With a fill rinse operation (sometimes referred to as a "deep fill" rinse), a load is rinsed by filling the wash tub with a quantity of fresh water, agitating the load with an agitator in the wash tub, and then draining the wash tub after some period of time. With a spray rinse operation, a load is rinsed by spraying the load with fresh water while spinning a wash basket, and generally while continuing to drain the wash tub. In some embodiments, for example, one or more fluid properties may be sensed in the wash fluid after a wash phase, e.g., while draining the wash tub, and the fluid properties may be used to sense a relative amount of detergent and/or soil in the wash fluid, which may be indicative of a relative amount of detergent and/or soil remaining in the load prior to a rinse phase of the wash cycle. Thus, for example, in some embodiments, when a fluid property indicates that a relatively larger amount of detergent and/or soil remains in the load, a fill rinse operation may be selected, while a lower detected amount of detergent and/or soil may be used to select a spray rinse operation instead.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
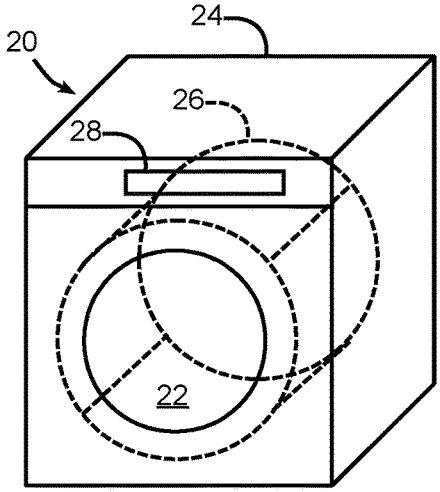
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques selection within a front-load laundry washing machine would be well within the abilities of one of ordinary skill in the art having the benefit of the instant disclosure, so the invention is not limited to the top-load implementation discussed further herein.

Figure 3:
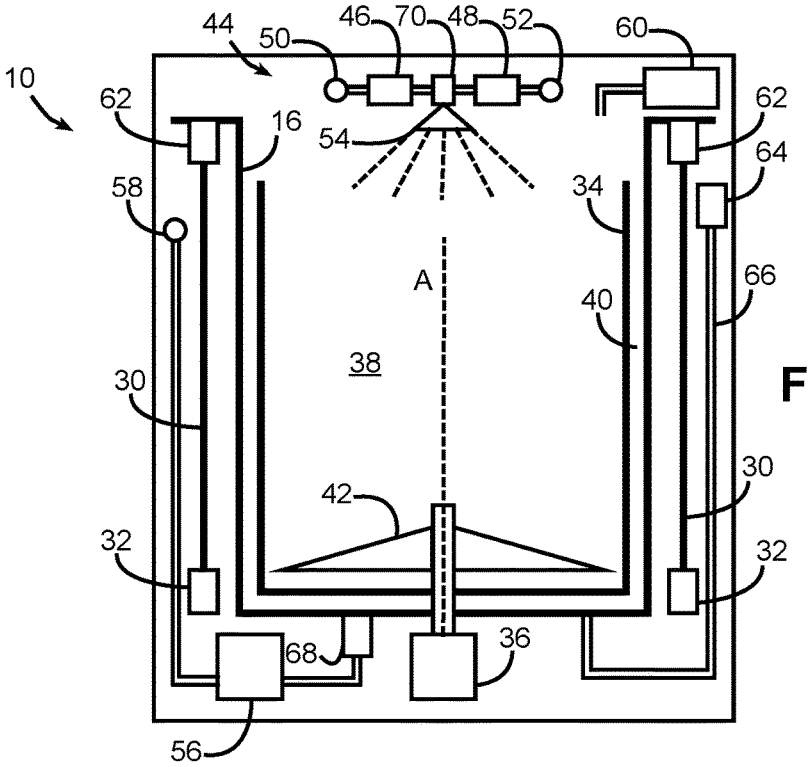
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16.

In some embodiments, laundry washing machine 10 may also include a dispensing system 60 configured to dispense detergent, fabric softener and/or other wash-related products into wash tub 16. Dispensing system 60 may include one or more dispensers, and may be configured in some embodiments as automated dispensers that dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, laundry washing machine 10 also includes at least a weight sensor, a fluid level sensor, and a fluid property sensor. A weight sensor may be used to generate a signal that varies based in part on the mass or weight of the contents of wash tub 16. In the illustrated embodiment, for example, a weight sensor may be implemented in laundry washing machine 10 using one or more load cells 62 that support wash tub 16 on one or more corresponding support rods 30. Each load cell 62 may be an electro-mechanical sensor that outputs a signal that varies with a displacement based on load or weight, and thus outputs a signal that varies with the weight of the contents of wash tub 16. Multiple load cells 62 may be used in some embodiments, while in other embodiments, other types of transducers or sensors that generate a signal that varies with applied force, e.g., strain gauges, may be used. Furthermore, while load cells 62 are illustrated as supporting wash tub 16 on support rods 30, the load cells, or other appropriate transducers or sensors, may be positioned elsewhere in a laundry washing machine to generate one or more signals that vary in response to the weight of the contents of wash tub 16. In some embodiments, for example, transducers may be used to support an entire load washing machine, e.g., one or more feet of a machine. Other types and/or locations of transducers suitable for generating a signal that varies with the weight of the contents of a wash tub will be apparent to one of ordinary skill in the art having the benefit of the instant disclosure. In addition, in some embodiments, a weight sensor may also be used for vibration sensing purposes, e.g., to detect excessive vibrations resulting from an out-of-balance load. In other embodiments, however, no vibration sensing may be used, while in other embodiments, separate sensors may be used to sense vibrations.

A fluid level sensor may be used to generate a signal that varies with the level or height of fluid in wash tub 16. In the illustrated embodiment, for example, a fluid level sensor may be implemented using a pressure sensor 64 in fluid communication with a low point, bottom or sump of wash tub 16 through a tube 66 such that a pressure sensed by pressure sensor 64 varies with the level of fluid within the wash tub, as it will be understood that the addition of fluid to the wash tub will generate a hydrostatic pressure within the tube that varies with the level of fluid in the wash tub, and that may be sensed, for example, with a piezoelectric or other transducer disposed on a diaphragm or other movable element. It will be appreciated that a wide variety of pressure sensors may be used to provide fluid level sensing, including, among others, combinations of pressure switches that trigger at different pressures. It will also be appreciated that fluid level in the wash tub may also be sensed using various non-pressure based sensors, e.g., optical sensors, laser sensors, etc.

A fluid property sensor, e.g., a turbidity sensor 68, may be used to measure the turbidity or clarity of the fluid in wash tub 16, e.g., to sense the presence or relative amount of various wash-related products such as detergents or fabric softeners and/or to sense the presence or relative amount of soil in the fluid. Further, in some embodiments, turbidity sensor 68 may also measure other properties of the fluid in wash tub 16, e.g., conductivity and/or temperature. In other embodiments, separate sensors may be used to measure turbidity, conductivity and/or temperature, and further, other sensors may be incorporated to measure additional fluid properties. In other embodiments, no turbidity sensor may be used.

In addition, in some embodiments, a flow sensor 70 such as one or more flowmeters may be used to sense an amount of water dispensed into wash tub 16. In other embodiments, however, no flow sensor may be used. Instead, water inlet 44 may be configured with a static and regulated flow rate such that the amount of water dispensed is a product of the flow rate and the amount of time the water is dispensed. Therefore, in some embodiments, a timer may be used to determine the amount of water dispensed into wash tub 16.

Figure 4:
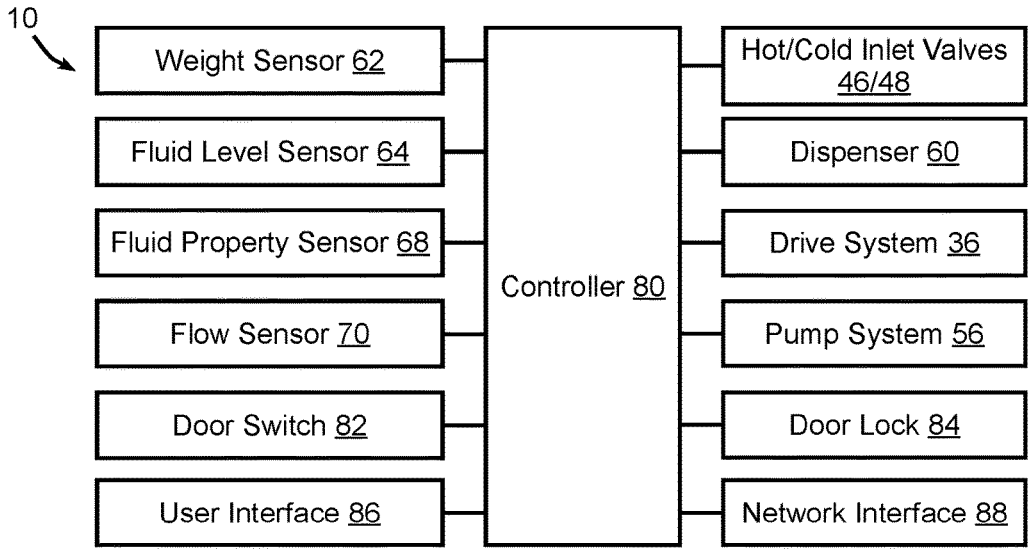
FIG. 4 is a block diagram of an example control system for the laundry washing machine of FIG. 1.

Now turning to FIG. 4, laundry washing machine 10 may be under the control of a controller 80 that receives inputs from a number of components and drives a number of components in response thereto. Controller 80 may, for example, include one or more processors and a memory (not shown) within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80.

As shown in FIG. 4, controller 80 may be interfaced with various components, including the aforementioned drive system 36, hot/cold inlet valves 46, 48, pump system 56, weight sensor 62, fluid flow sensor 64, fluid property sensor 68, and flow sensor 70. In addition, controller 80 may be interfaced with additional components such as a door switch 82 that detects whether door 12 is in an open or closed position and a door lock 84 that selectively locks door 12 in a closed position. Moreover, controller 80 may be coupled to a user interface 86 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 80 may also be coupled to one or more network interfaces 88, e.g., for interfacing with external devices via wired and/or wireless networks such as Ethernet, Bluetooth, NFC, cellular and other suitable networks. Additional components may also be interfaced with controller 80, as will be appreciated by those of ordinary skill having the benefit of the instant disclosure. Moreover, in some embodiments, at least a portion of controller 80 may be implemented externally from a laundry washing machine, e.g., within a mobile device, a cloud computing environment, etc., such that at least a portion of the functionality described herein is implemented within the portion of the controller that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 5:
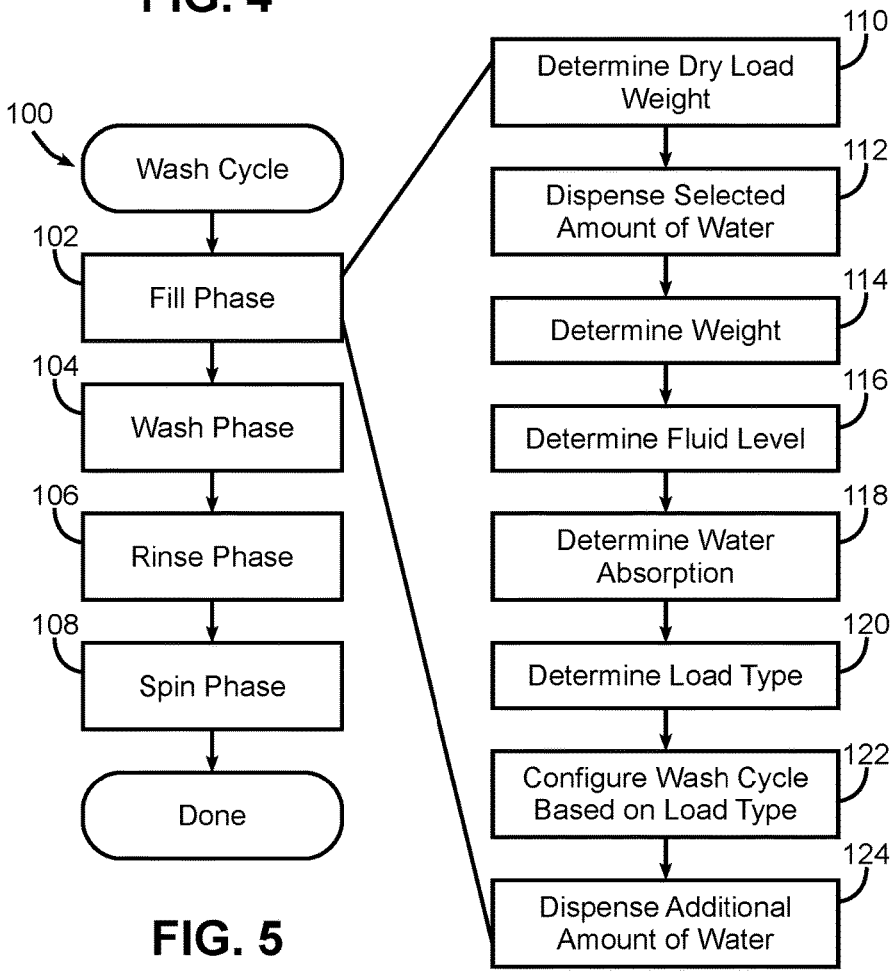
FIG. 5 is a flowchart illustrating an example sequence of operations for implementing a wash cycle in the laundry washing machine of FIG. 1.

Now turning to FIG. 5, and with continuing reference to FIGS. 3-4, a sequence of operations 100 for performing a wash cycle in laundry washing machine 10 is illustrated. A typical wash cycle includes multiple phases, including an initial fill phase 102 where the wash tub is initially filled with water, a wash phase 104 where a load that has been placed in the wash tub is washed by agitating the load with a wash liquor formed from the fill water and any wash products added manually or automatically by the washing machine, a rinse phase 106 where the load is rinsed of detergent and/or other wash products (e.g., using a fill rinse where the wash tub is filled with fresh water and the load is agitated and/or a spray rinse where the load is sprayed with fresh water while spinning the load), and a spin phase 108 where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different spin speeds, different water amounts, different wash product amounts, etc.

In some embodiments consistent with the invention, a load type may be automatically selected during the initial fill phase 102 based in part on weight and fluid level values sensed respectively by the weight and fluid level sensors 62, 64 after a selected amount of water has been dispensed by water inlet 44. In some embodiments, the automatic selection may be performed in response to selection of a particular mode (e.g., an "automatic" mode), while in other embodiments, automatic selection may be used for all wash cycles.

In some embodiments, the load type may be selected from among a plurality of different load types based in part of dry load weight and one or more water absorption parameters for the load determined from sensed weight and fluid level. Blocks 110-124, for example, illustrate one example sequence of operations for performing automatic load type selection in some embodiments of the invention. In block 110, a dry load weight is determined, e.g., by determining a weight value from weight sensor 62 prior to introducing water into wash tub 16. The dry weight may be calculated, for example, by subtracting from the weight sensed by weight sensor 62, the weight of wash tub 16 when empty (e.g., as stored in a memory or measured prior to placement of the load in the wash tub).

Next, in block 112, a selected amount of water is dispensed, e.g., by controlling valves 46, 48 of water inlet 44 to dispense a selected, e.g., a known, preset or predetermined, amount of water into the wash tub. In some embodiments, the amount of water may be determined by monitoring flow sensor 70, while in other embodiments, the amount of water may be determined by monitoring the fill duration and multiplying by a known flow rate of the water inlet 44.

Blocks 114-116 next determine weight and fluid level values based upon outputs of the weight and fluid level sensors 62, 64 after the selected amount of water has been dispensed into the wash tub. In some embodiments, dispensing of water by water inlet 44 may be paused at least momentarily prior to sensing the weight and fluid level and/or selecting a load type, while in some embodiments, the dispensing of water may be continued during the determination of weight and fluid level and/or selection of load type.

In some embodiments, weight and fluid level values determined in blocks 114 and 116 may be correlated or otherwise associated with the selected amount of dispensed water. Further, in some embodiments, the weight and fluid level values may be correlated to the same amount of dispensed water, while in other embodiments, the weight and fluid level values may be correlated to different amounts of dispensed water, i.e., the weight and fluid level may be measured after different amounts of water have been dispensed into the wash tub. Further, as will become more apparent below, in some embodiments multiple weight and/or fluid level values may be collected and correlated with multiple amounts of dispensed water.

Next, in block 118, one or more water absorption parameters is calculated, e.g., based upon the weight and fluid level values, the dry weight of the load, and the amount of dispensed water, and then in block 120, a load type is determined based upon the one or more determined water absorption parameters.

In one embodiment, for example, one type of water absorption parameter, referred to herein as a combined water absorption parameter, may be calculated using Eq. (1) below:

$$M_T = f(\mathrm{Lim}_{0\to x}\%\ M_T LC, \mathrm{Lim}_{0\to x}\%\ M_T PS) \quad (1)$$

where X represents time, $M_T$ is the combined water absorption parameter, $\mathrm{Lim}_{0\to x}\%\ M_T\mathrm{LC}$ is a load cell-based water absorption limit parameter using a load cell-measured representation of the water content retained in the load items, and $\mathrm{Lim}_{0\to x}\%\ M_T\mathrm{PS}$ is a pressure sensor-based water absorption limit parameter using a pressure sensor-measured representation of the water retained in the load items.

In addition, in this embodiment, each load type among multiple supported load types may be associated with a constant (e.g., a single value or a range of values) that may be determined empirically for that load type, such that a comparison of a water absorption parameter such as the aforementioned combined water absorption parameter with the constants associated with the different load types may be used to select a matching load type for the load. Further, each load type may be associated with additional constants, e.g., based upon dry load weight, such that selection of a matching load type may be based on multiple parameters or values.

It will be appreciated that in some embodiments, different load types may have overlapping characteristics and constants such that determination of a load type based upon one or more water absorption parameters may present a nonlinear system, and as such, various nonlinear solution techniques, e.g., fuzzy logic, artificial neural networks, etc. may be used to select a load type based upon one or more water absorption parameters.

Once a load type is selected in block 120, block 122 next configures the wash cycle based on the selected load type. For example, each load type may be associated with a set of operational settings stored in controller 80 such that selection of a particular load type causes controller 80 to access the set of operational settings for the selected load type when completing the remainder of the wash cycle.

Next, block 124 dispenses an additional amount of water to complete the fill cycle. For example, the additional amount of water may be selected to provide a total amount of dispensed water selected based upon load type or selected via a separate load size selection by the user. In other embodiments, the amount of water dispensed in block 112 may be the total amount of water dispensed during the fill phase, and block 124 may be omitted. Nonetheless, in some embodiments, even when no additional water is dispensed after selecting load type, the load type is selected prior to transitioning to the wash phase, and thus prior to any agitation of the load and/or draining of fluid from the wash tub. Furthermore, it will be appreciated that the amount of time expended selecting the load type may be minimal or even imperceptible in some embodiments.

In some embodiments, and as noted above determination of a load type may also be based in part on one or more fluid properties sensed by a fluid property sensor 68. In addition, in some embodiments, additional operational settings may be determined for the wash cycle based at least in part on sensed fluid properties.

For example, in one example embodiment, a dispensing system may dispense a predetermined amount of detergent based upon a load type, weight, etc. A fluid property sensor may be placed in line with either a secondary pump used for recirculating wash fluid back into the wash tub or in line with a single pump that discharges fluid out of the machine. Once a predetermined dosage of water has been placed in the wash tub during dynamic selection of a load type, the fluid property sensor may take an initial measurement of water without detergent being added to the wash tub. After the load type is selected, a detergent may be added with a remaining appropriate dosage of water to wash the load. After a predetermined agitation has commenced another fluid property sensing may be used to check the detergent amount and add additional detergent if the wash liqueur concentration is low, e.g., by comparing a conductivity sensing with a turbidity sensing. Both may be checked throughout a wash cycle to confirm that the wash cycle is working effectively. Washing profile and stroke may also be adjusted in order to optimize the wash cycle. Once the wash cycle is complete the laundry washing machine may then conduct a spray rinse or fill rinse depending on the concentration of particulates in the wash fluid, as measured using the fluid property sensor. If the garments in the load are only lightly soiled for example a spray rinse may be selected, but if heavy concentrations of soil and/or detergent are present a deep water rinse may be selected instead. With either option selected, the length of time of the rinse operation may be adjusted based on turbidity and conductivity sensing. Further, if additional rinse is needed, an additional rinse may also be conducted, and once appropriate levels of rinse have been achieved the spin phase may be commenced, with configuration of the spin phase based principally on the selected load type.

Figure 6A:
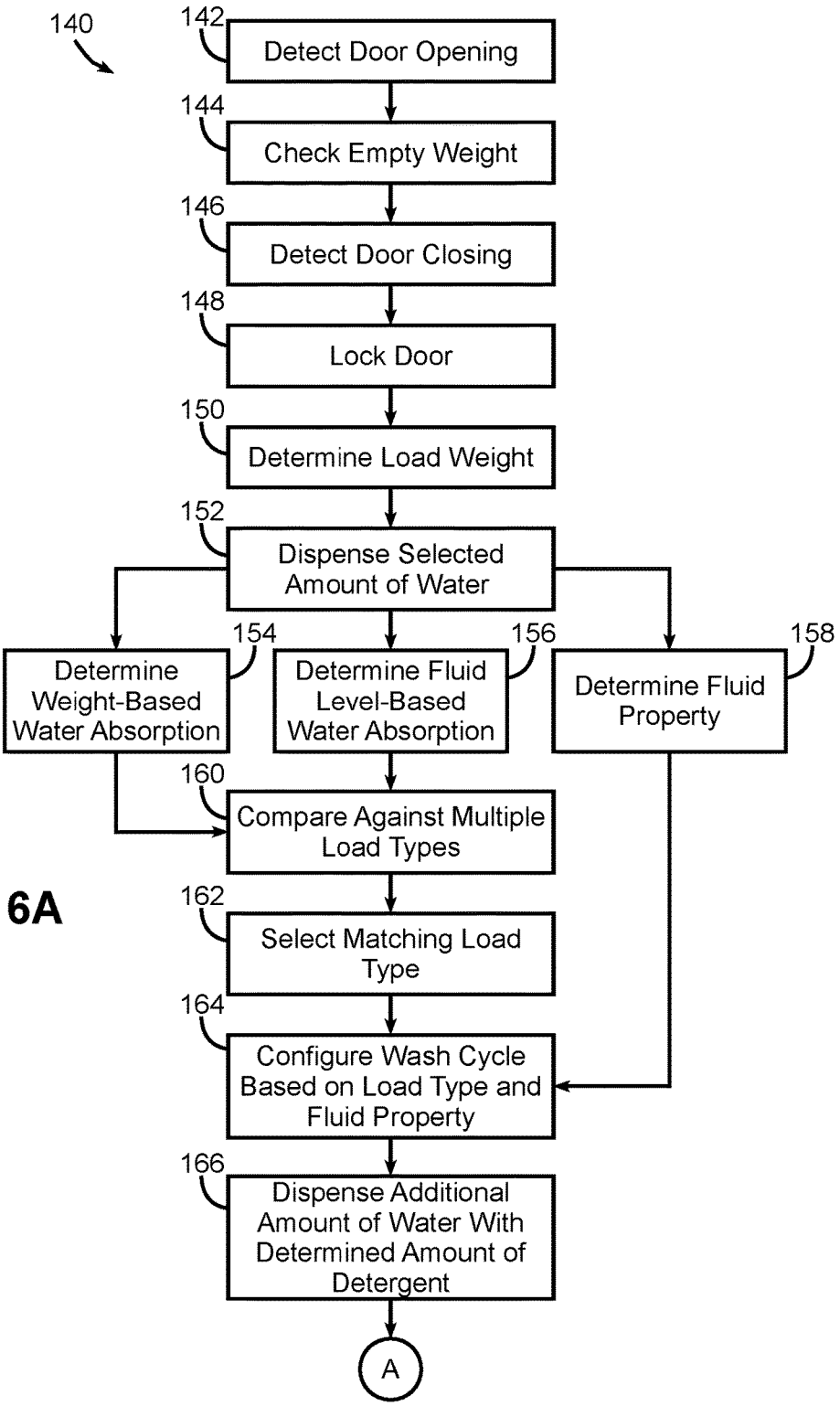
FIGS. 6A and 6B are flowcharts illustrating another example sequence of operations for implementing a wash cycle in the laundry washing machine of FIG. 1.
Figure 6B:
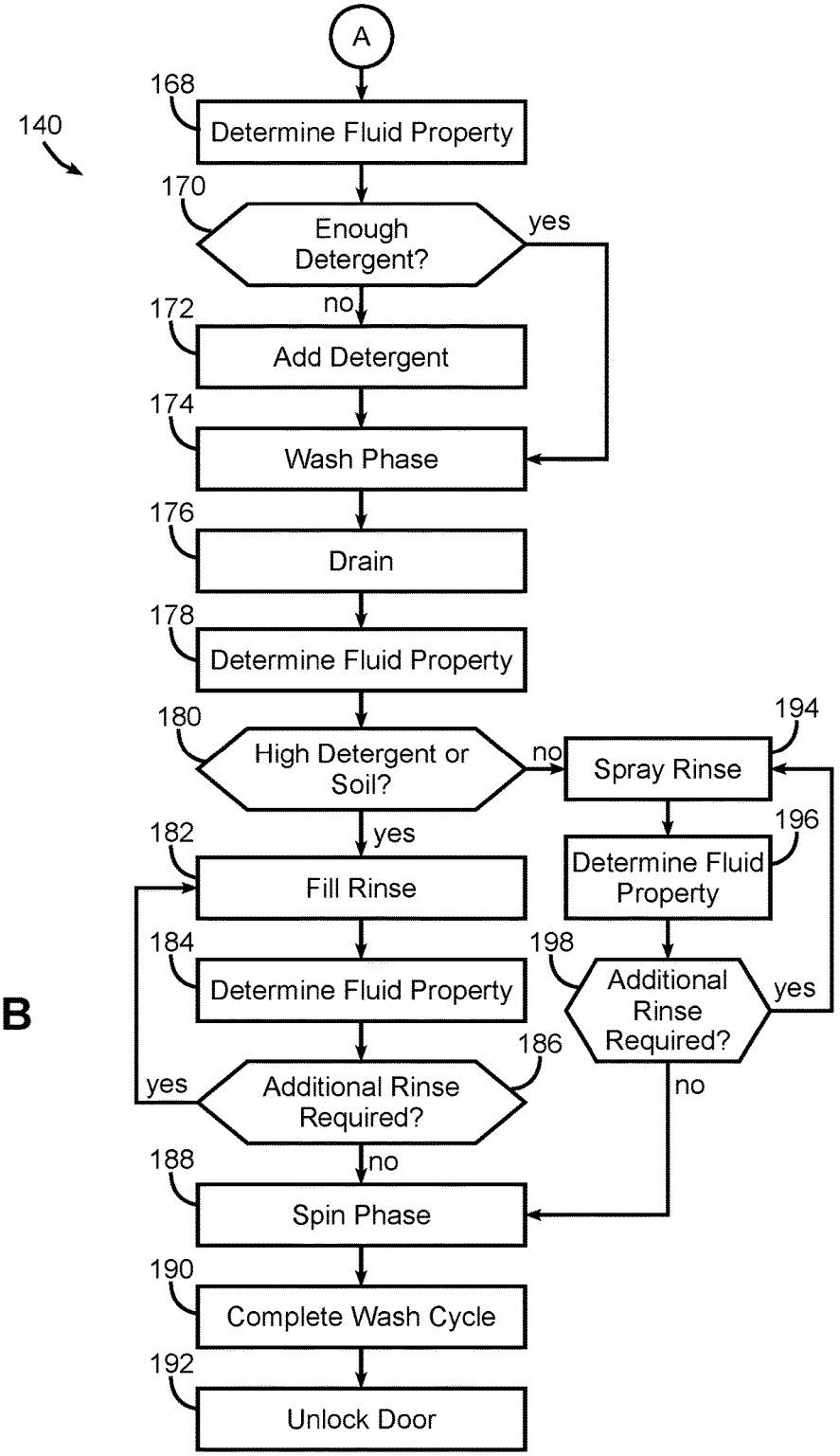

FIGS. 6A and 6B next illustrate another sequence of operations 140 that may be used to implement a wash cycle consistent with the invention. As shown in FIG. 6A, block 142 initially detects opening of the washing machine door, e.g., using door switch 82, and upon opening, block 144 determines a tare weight assuming wash tub 16 is empty using weight sensor 62.

Block 146 then detects the door closing using door switch 82. Block 146 may also check the output of weight sensor 62 to determine that a load has been placed in the wash tub, and then pass control to block 148 to initiate actuation of door lock 84 to lock the door. A safety algorithm may also be performed at this time to determine whether the machine is able to proceed with a wash cycle. Next, block 150 determines the load weight using weight sensor 62 and the tare weight determined in block 144.

Block 152 next controls water inlet 44 to dispense a selected amount of water, and blocks 154 and 156, which may be executed sequentially in either order or in parallel, and which may be executed during a pause in the dispensing of water or concurrently with dispensing additional water, determine respective weight-based and fluid level-based water absorption parameters, e.g., using Eqs. (2) and (3)

below, which may then be used to generate the $M_T$ combined water absorption parameter as described above in connection with Eq. (1):

$$\mathrm{Lim}_{0\to x}\%\ M_T LC=(W_{1X}+W_{2X}-W_{0X})/(W_{1X}+W_{2X})*100 \quad (2)$$

$$\mathrm{Lim}_{0\to x}\%\ M_T PS=(PS_{1X}+PS_{2X}-PS_{0X})/(PS_{1X}+PS_{2X})*100 \quad (3)$$

where X represents time, $\mathrm{Lim}_{0\to x}\%\ M_T LC$ is a type of weight-based water absorption parameter referred to herein as a load cell-based water absorption limit parameter using a load cell-measured representation of the water content retained in the load items, $\mathrm{Lim}_{0\to x}\%\ M_T PS$ is a type of fluid level-based water absorption parameter referred to herein as a pressure sensor-based water absorption limit parameter using a pressure sensor-measured representation of the water retained in the load items, $W_0$ represents a dry load weight, $W_1$ represents a weight of water and load, $W_2$ represents a weight of the boundary water (i.e., water that does not touch the load and has no chance to absorb, $PS_0$ represents a volume of water dispensed, $PS_1$ represents a volume of water detected, and $PS_2$ represents a volume of the boundary water (i.e., water that does not touch the load and has no chance to absorb). It will be appreciated that, in some embodiments, one or more of the above values may be estimated based upon the geometry of a particular wash tub design and/or other design aspects of a particular washing machine design. Further, it will be appreciated that, in some embodiments, empirical testing may be used to derive the functions for any of the aforementioned water absorption parameters for particular washing machine designs relative to weight and fluid level sensor outputs.

Also concurrently or sequentially relative to block 154 and 156, block 158 may determine one or more fluid properties, e.g., turbidity and/or conductivity, of the fluid in the wash tub, desirably prior to adding any detergent using dispensing system 60 such that a reference value may be obtained against which the wash fluid after the addition of detergent may be compared. Obtaining fluid properties at this time may also be used in some embodiments to check for soil level, e.g., to detect excess soil when a fluid property exceeds to reference value. In some instances, it may also be desirable to agitate the load at this time and/or delay the fill to enable any detergent in the wash tub and/or soil in the load to more evenly disperse throughout the fluid in the wash tub prior to sensing by the fluid property sensor.

As noted above in some embodiments, the fluid property may be used in connection with configuring other operational settings for the wash cycle, either in combination with load type or separate therefrom. For example, in some embodiments, Eq. (4) may be used to evaluate suspended-sediment concentration based on sensed turbidity:

$$\mathrm{Log}_{10}(\mathrm{SSC})=a*\mathrm{Log}_{10}(\mathrm{Turb})+b \quad (4)$$

where SSC is suspended-sediment concentration, in mg/L (amount of dry sediment per liter), Turb is turbidity, in nephelometric units (NTU), which measures how much light is scattered by suspended particles, a is a regression coefficient and b is Duan's bias correction factor.

In another embodiment, sensed turbidity (e.g., in NTU) may be compared against upper and lower limits of allowable detergent concentration in units of NTU such that when the sensed turbidity is between the limits no additional detergent is needed and the detergent concentration is correct.

Irrespective of whether fluid properties are used in the selection of load type, in the illustrated embodiment, each load type among multiple supported load types may be associated with a constant (e.g., a single value or a range of values) for each of the weight-based and fluid level-based water absorption parameters (e.g., the aforementioned load cell-based and pressure sensor-based water absorption limit parameters) that may be determined empirically for that load type, and such that a comparison of the weight-based and fluid level-based water absorption parameters with the constants associated with the different load types may be used to select a matching load type for the load. As such, block 160 compares these parameters against multiple load types, and block 162 selects a matching load type based upon the comparison.

Then, once a load type is selected, block 164 configures the wash cycle based on the selected load type, and may also at this time configure additional operational settings based at least in part on the sensed fluid properties. Some operational settings, for example, may be based solely on load type, while some operational settings may be based solely on fluid properties and some operational settings may be based on a combination of load type and fluid properties. Some operational settings may also be configured separate of load type and/or fluid properties. Block 166 next optionally dispenses an additional amount of water to complete the fill cycle, similar to blocks 122 and 124.

It will be appreciated that load type selection may be implemented in a number of other manners in other embodiments. For example, different equations may be used in other embodiments to represent different relationships between load type and load weight, fluid level, fluid properties, water absorption, and/or water absorption rate. In addition, it will be appreciated that while parameters and values are described in the illustrated embodiments in terms of weights, fluid levels, absorbency, etc., the actual parameters or values need not correspond to particular dimensions of weight, mass, volume, length, etc., as it is generally the fact that different loads have different relative weights, absorbencies, absorbency rates and other characteristics that may be utilized to categorize loads into different load types. For example, in the case of fluid level sensor 64 implemented using a pressure sensor, it is generally not necessary to convert a pressure value sensed by the sensor into any particular units of pressure, or even into any particular level, height, or volume of water in the wash tub that is represented by the sensor output. As such, various equations that distinguish between different load types based at least in part upon the outputs of weight and/or fluid level sensors may be used, as will be appreciated by those of ordinary skill the art having the benefit of the instant disclosure.

Further, multiple values of weight and/or fluid level may be collected at different times and/or after dispensing different amounts of water, and may be used to determine load type in different embodiments. In some embodiments, for example, water absorbency rate may be determined in part by determining multiple fluid level values sensed by the fluid level sensor while pausing dispensing of water by water inlet 44, with a decrease in fluid level being seen as water is absorbed into the load.

Now turning to FIG. 6B, sequence of operations 140 continues with block 168 again determining one or more fluid properties for the fluid in the wash tub, this time for the purpose of determining whether a sufficient amount of detergent is in the wash tub for the given load. For example, turbidity and/or conductivity may be used to determine a concentration of detergent, such that if an insufficient amount of detergent is in the wash tub, additional detergent may be dispensed by an automated detergent dispenser in dispensing system 60. In some embodiments, for example, a user may be permitted to manually add detergent to the wash tub or to a manual dispenser prior to the start of a wash cycle, whereby block 170 may determine if sufficient detergent is present in the wash tub. If not, block 170 may pass control to block 172 to add a controlled amount of detergent to the wash tub by actuating dispensing system 60, and then to block 174 to initiate the wash phase of the wash cycle. If sufficient detergent is present, however, block 170 may bypass block 172 and pass control directly to block 174 to initiate the wash phase of the wash cycle.

It will be appreciated, however, that in other embodiments no manual addition of detergent may be supported, such that all detergent is dispensed in an automated fashion using dispensing system 60. In such instances, dispensing of detergent by dispensing system 60 in block 172 may be unconditional. Further, it will be appreciated that the amount of detergent to dispense may be configured based upon load type, load weight, fluid properties and/or user settings in various embodiments.

The wash phase performed in block 174 may include, for example, agitation with agitator 42, with various operational settings configured for the wash phase in the manner discussed above. At the completion of the wash phase, block 176 drains the wash tub, and block 178 may determine one or more values for one or more fluid properties (e.g., turbidity and/or conductivity), this time to select from among multiple available rinse operation types to use in the upcoming rinse phase. Specifically, in the illustrated embodiment, the sensed fluid properties are used to determine in block 180 whether high detergent or soil is present in the draining fluid, and if so, control passes to block 182 to perform a fill rinse, e.g., a deep fill rinse. Block 184 then determines the one or more fluid properties at the completion of the deep fill rinse, and block 186 determines based upon the one or more fluid properties whether additional rinsing is required. If so, control returns to block 182 to perform another fill rinse operation. Otherwise, control passes to block 188 to proceed to the spin phase. Any remaining phases of the wash cycle are then completed in block 190, and upon completion of the wash cycle, the door is unlocked in block 192 by deactivating door lock 84.

Returning to block 180, if high detergent or soil is not present in the draining fluid, control passes to block 194 to perform a spray rinse. Block 196 then determines the one or more fluid properties at the completion of the spin rinse, and block 198 determines based upon the one or more fluid properties whether additional rinsing is required. If so, control returns to block 194 to perform another spray rinse operation. Otherwise, control passes to blocks 188-192 to complete the wash cycle in the manner described above.

It will be appreciated that the automatic cycle described in connection with FIGS. 6A-6B may, in some instances, be implemented as a completely automatic cycle from the perspective of a user. A user may, in some embodiments, simply place a load in the laundry machine and press a single button or other user interface control, and have the various operational settings for the wash cycle controlled via the various sensors discussed above. In some embodiments, this automatic cycle may be the only cycle supported by the laundry washing machine, while in other embodiments, additional cycles and/or settings may also be configurable by a user.

Figure 7:
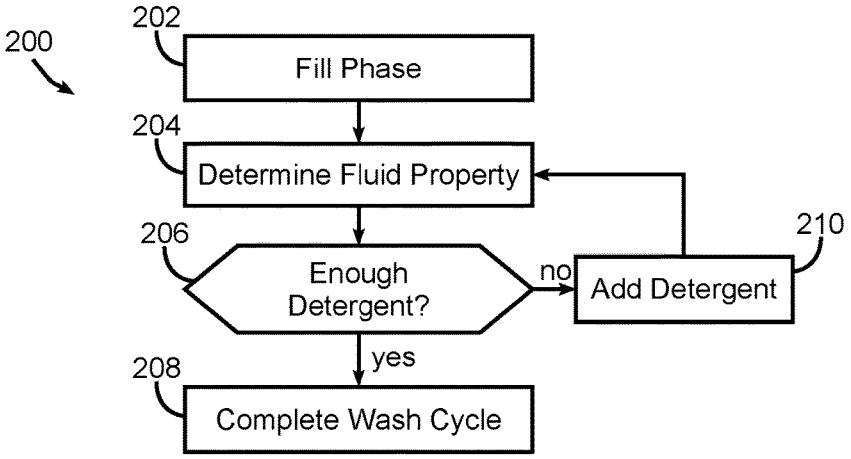
FIG. 7 is a flowchart illustrating another example sequence of operations for implementing a wash cycle in the laundry washing machine of FIG. 1, including an automated dispensing of detergent in response to detection of a detergent deficit.

In still other embodiments, however, all of the features discussed above in connection with FIGS. 6A-6B need not be implemented. FIG. 7, for example, illustrates a sequence of operations 200 suitable for use in a laundry washing machine including a fluid property sensor and an automated detergent dispenser, but not necessarily including weight and/or fluid level sensors, nor any automatic load type selection. Sequence of operations 200 may be used, for example, to ensure that no detergent deficit exists prior to or during a wash phase of a wash cycle, particularly in laundry machine designs where users are anticipated to manually add detergent to the laundry washing machine prior to starting a wash cycle. Thus, for example, a wash cycle may begin in block 202 by performing the fill phase of the wash cycle, then block 204 may determine a fluid property (e.g., turbidity and/or conductivity) to assess the amount of detergent in the wash fluid in the wash tub after the fill phase is completed. If enough detergent is present, block 206 may pass control to block 208 to complete the wash cycle without adding detergent. On the other hand, if not enough detergent is present, block 206 may instead pass control to block 210 to add additional detergent to the wash tub, and then to block 208 to complete the wash cycle using the additional detergent. Block 210 may also determine an amount of detergent needed to supplement the detergent already added to the wash tub, e.g., based upon determining a desired amount of detergent (e.g., a desired concentration), determining an actual amount of detergent (e.g., an actual concentration), and then determining an amount of additional detergent needed to increase the concentration of detergent in the wash tub from the actual to the desired concentration. For example, Eq. (5) may be used to determine an additional volume of detergent to dispense ($V_D$) in some embodiments:

$$V_D = V_W(C_{DES} - C_{MEAS}) \tag{5}$$

where $V_W$ is the volume of water dispensed to the wash tub, $C_{DES}$ is the desired concentration of detergent in the wash fluid, and $C_{MEAS}$ is the measured concentration of detergent in the wash fluid based upon turbidity and/or conductivity measurements taken by a fluid property sensor.

Figure 8:
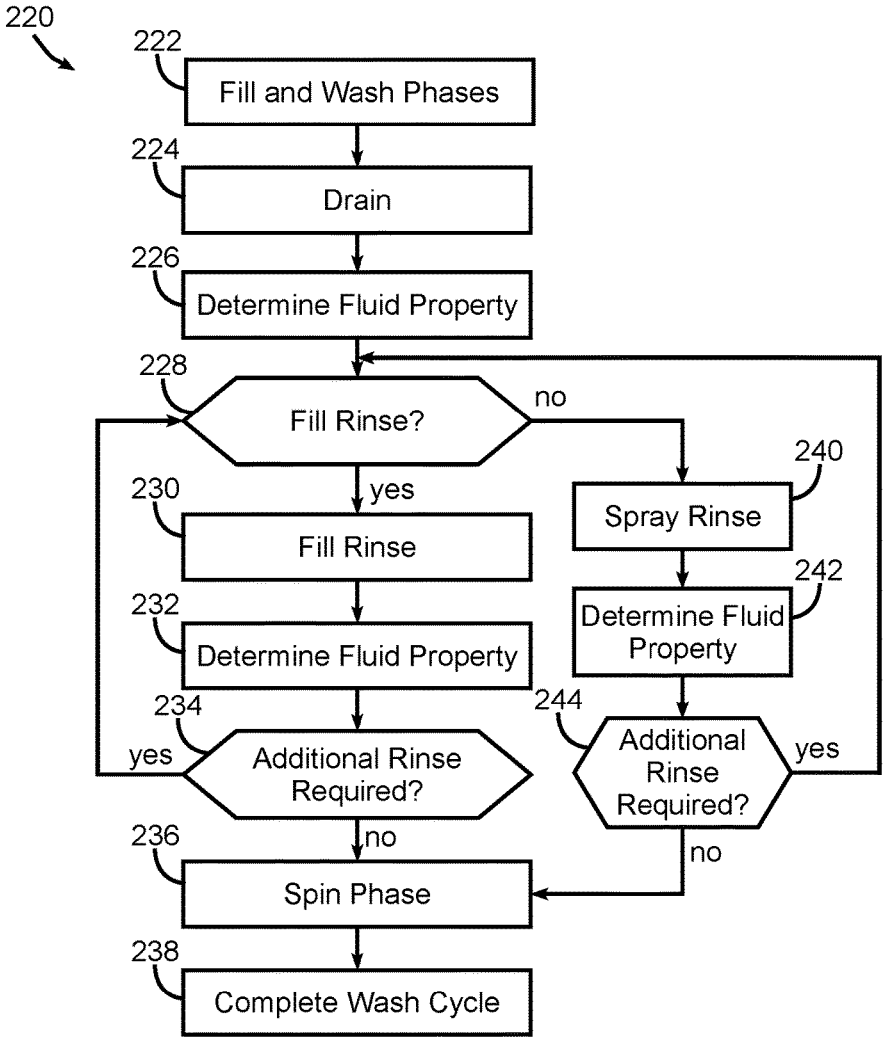
FIG. 8 is a flowchart illustrating another example sequence of operations for implementing a wash cycle in the laundry washing machine of FIG. 1, including an automated selection of a rinse operation type.

FIG. 8, as another example, illustrates a sequence of operations 220 suitable for use in a laundry washing machine including a fluid property sensor and an automated detergent dispenser, but not necessarily including weight and/or fluid level sensors, nor any automatic detergent dispenser or even any automatic load type selection. Sequence of operations 220 may be used, for example, to select from between different rinse operation types based upon a property of the wash fluid used during the wash phase of a wash cycle.

Thus, for example, a wash cycle may begin in block 222 by performing the fill and wash phases of the wash cycle, then block 224 may drain the wash tub, and block 226 may determine one or more fluid properties (e.g., turbidity and/or conductivity) to assess the amount of detergent and/or soil in the wash fluid being drained from the wash tub.

Block 228 may then use the one or more fluid properties to determine whether to perform a fill rinse or a spray rinse. As discussed above, a fill rinse may be desirable when higher levels of detergent and/or soil are present in the wash fluid, and as such, block 228 may compare against a threshold in some embodiments to select between the different rinse operation types.

If a fill rinse is indicated by block 228, control passes to block 230 to perform a fill rinse, e.g., a deep fill rinse. Block 232 then determines one or more fluid properties at the completion of the deep fill rinse, and block 234 determines based upon the one or more fluid properties whether additional rinsing is required. If so, control may, in this embodiment, return to block 228 to determine whether to perform a fill or spray rinse for the additional rinse operation (which it should be noted differs from the sequence of operations illustrated in FIGS. 6A-6B, where additional fill operations are of the same rinse operation type once a rinse operation type is selected). Otherwise, control passes to block 236 to proceed to the spin phase. Any remaining phases of the wash cycle are then completed in block 238.

Returning to block 228, if a fill rinse is not indicated, control passes to block 240 to perform a spray rinse. Block 242 then determines the one or more fluid properties at the completion of the spin rinse, and block 244 determines based upon the one or more fluid properties whether additional rinsing is required. If so, control returns to block 228; otherwise, control passes to blocks 236-238 to complete the wash cycle in the manner described above.

Various additional modifications may be made to the illustrated embodiments consistent with the invention. Therefore, the invention lies in the claims hereinafter appended.

What is claimed is:

1. A laundry washing machine, comprising:

a wash tub disposed within a housing;

a fluid property sensor configured to sense turbidity and/or conductivity of fluid from the wash tub; and a controller coupled to the fluid property sensor, the controller configured to initiate a wash phase of a wash cycle to wash a load disposed in the wash tub, determine prior to initiating a rinse phase of the wash cycle and with the fluid property sensor a fluid property value associated with the wash fluid used during the wash phase of the wash cycle to assess a concentration of detergent and/or soil in the wash fluid, select prior to initiating the rinse phase of the wash cycle between a fill rinse operation and a spray rinse operation for a rinse phase of the wash cycle based at least in part upon the determined fluid property value, and after selecting between the fill rinse operation and the spray rinse operation, initiate the rinse phase of the wash cycle using the selected fill rinse or spray rinse operation, wherein the controller is configured to select between the fill rinse operation and the spray rinse operation by:

determining from the determined fluid property value whether the concentration of detergent and/or soil in the wash fluid meets a threshold;

selecting the fill rinse operation for the rinse phase in response to the threshold being met; and selecting the spray rinse operation for the rinse phase in response to the threshold not being met.

2. The laundry washing machine of claim 1, wherein the fluid property sensor includes a turbidity sensor configured to measure turbidity of the fluid from the wash tub, and wherein the controller is configured to select between the fill rinse operation and the spray rinse operation at least based upon turbidity of the fluid from the wash tub.

3. The laundry washing machine of claim 2, wherein the turbidity sensor is further configured to measure conductivity of the fluid from the wash tub, and wherein the controller is further configured to select between the fill rinse operation and the spray rinse operation based upon conductivity of the fluid from the wash tub.

4. The laundry washing machine of claim 1, wherein the controller is further configured to determine whether to perform an additional rinse operation based at least in part upon a second fluid property value sensed by the fluid property sensor after the selected fill rinse operation or spray rinse operation is performed.

5. The laundry washing machine of claim 4, wherein the controller is configured to select between the fill rinse operation and the spray rinse operation to be performed as the additional rinse operation based upon the second fluid property value.

6. The laundry washing machine of claim 4, wherein the controller is configured to repeat the selected fill rinse operation or spray rinse operation as the additional rinse operation.

7. The laundry washing machine of claim 1, further comprising a weight sensor operatively coupled to the wash tub to sense a weight associated with the wash tub and a fluid level sensor configured to sense a fluid level in the wash tub, wherein the controller is configured to dynamically select a load type from among a plurality of load types based at least upon weight and fluid level values sensed respectively by the weight and fluid level sensors, and to control a wash cycle at least based upon the selected load type.

8. The laundry washing machine of claim 7, further comprising a water inlet configured to dispense water into the wash tub, wherein the controller is further configured to initiate an initial fill phase of a wash cycle by controlling the water inlet to dispense water into the wash tub and to dynamically select the load type during the initial fill phase after a selected amount of water has been dispensed by the water inlet.

9. The laundry washing machine of claim 1, further comprising a detergent dispenser configured to dispense detergent for washing a load disposed in the wash tub, wherein the controller is configured to control dispensing of detergent by the detergent dispenser based at least in part upon the fluid property value.

10. The laundry washing machine of claim 1, wherein determining from the determined fluid property value whether the concentration of detergent and/or soil in the wash fluid meets a threshold includes determining from the determined fluid property value whether the concentration of soil in the wash fluid meets the threshold.

* * * * *